US005797727A

United States Patent [19]

Peters et al.

[11] Patent Number: 5,797,727

[45] Date of Patent: Aug. 25, 1998

[54] IMPELLER MOUNTING FOR ELECTRICALLY DRIVEN AIR PUMP TO REDUCE VIBRATION

[75] Inventors: Rainer Peters, Goch; Michael Bonse, Düsseldorf; Günter van de Venne, Monchen-Gladbach, all of Germany

[73] Assignee: Pierburg AG, Neuss, Germany

[21] Appl. No.: 821,515

[22] Filed: Mar. 21, 1997

[30] Foreign Application Priority Data

Mar. 23, 1996 [DE] Germany ..... 196 11 512.6

[51] Int. Cl.[6] ..... F04D 29/34

[52] U.S. Cl. ..... 416/204 R

[58] Field of Search ..... 416/204 R; 415/216.1; 403/354, 341

[56] References Cited

U.S. PATENT DOCUMENTS

| | | | |
|---|---|---|---|
| 1,173,289 | 2/1916 | McKee et al. | 403/341 |
| 1,251,836 | 1/1918 | Stufflebeam | 403/341 |
| 2,857,849 | 10/1958 | Pezzillo et al. | 107/87 |
| 2,990,895 | 7/1961 | Works et al. | 415/216.1 |
| 3,084,852 | 4/1963 | Seavey | 230/272 |
| 5,141,392 | 8/1992 | Uvemo | 415/216.1 |
| 5,269,572 | 12/1993 | Mefferd | 403/341 |

FOREIGN PATENT DOCUMENTS

| | | |
|---|---|---|
| 0385298 | 9/1990 | European Pat. Off. . |
| 0603665 | 6/1994 | European Pat. Off. . |
| 4107049 | 9/1992 | Germany . |
| 4409629 | 9/1994 | Germany . |
| 28866 | 11/1910 | United Kingdom . |

*Primary Examiner*—John T. Kwon
*Attorney, Agent, or Firm*—Ladas & Parry

[57] ABSTRACT

An electrically driven air pump having a housing containing a pump unit driven from a shaft of an electric motor, the pump unit including two impellers made of plastic having hubs which are press-fit on the shaft of the electric motor. A collar is also press-fit on the shaft and abutting against the hub of one impeller on a side thereof facing the electric motor, and a lock ring made of metal is press-fit on the shaft and abuts against the hub of the other impeller on a side thereof facing away from the electric motor thereby to clamp the impellers between the collar and the lock ring. The lock ring and the hub of the adjoining impeller are formed at their mutually abutting surfaces with a tooth and groove arrangement to prevent relative rotary movement therebetween. A similar tooth and groove arrangement can be provided between the abutting surfaces of the impellers and between the abutting surfaces of the collar and the adjoining impeller.

9 Claims, 2 Drawing Sheets

IMPELLER MOUNTING FOR ELECTRICALLY DRIVEN AIR PUMP TO REDUCE VIBRATION

FIELD OF THE INVENTION

The invention relates to improvements in electrically driven air pumps, for example, for use in motor vehicles to pump secondary air into the exhaust system to improve exhaust gases and lower pollution.

More particularly, the invention relates to improvements in the mounting of the impellers of such pumps to reduce vibration.

BACKGROUND AND PRIOR ART

In a conventional pump as disclosed in EPA 0 385 298 A2, its operation is inevitably associated with vibration due to unbalanced rotation of the impeller and the electric motor and of the rotary magnetic field that is produced. These vibrations are transferred to the pump support and to apparatus connected to the pump to produce high frequency noise while the pump is operating.

In an attempt to reduce this noise, DE-A1 41 07 049 discloses an arrangement in which the electric motor is supported by means of two elastic motor bearings between the electric motor and the housing. The pump impeller comprises several parts that have to be balanced.

U.S. Pat. No. 2,857,849 discloses a pump construction in which several pump impellers are attached to the shaft of an electric motor by means of a bolt that is screwed into the hub or boss of the pump impeller transversely to the longitudinal axis of the pump so that the bolt presses against the shaft. The screw threads must be adequately strong for this purpose whereby the impellers are made of metal. These are heavy and exhibit unbalanced rotation.

SUMMARY OF THE INVENTION

An object of the invention is to provide a construction for an electrically driven air pump which is simplified and provides reduced operating noise.

The above and further objects are satisfied in accordance with the invention, by providing an improvement in an electrically driven air pump, having a housing containing a pump unit, driven from a shaft of the electric motor, wherein according to said improvement an impeller unit of the pump is made of plastic and includes a hub which is press-fit on the shaft of the electric motor, the impeller unit having one end which abuts against a collar also press-fit on the shaft, a lock ring made of metal also being press-fit on the shaft and abutting against the hub of the impeller unit on the opposite end thereof. The abutting surfaces of the lock ring and the hub of the impeller unit include respectively engaging tooth and groove means to prevent relative rotary movement between the impeller unit and the lock ring.

In further accordance with the invention, the tooth and groove means provides a key and keyway connection which comprises a tooth on one of the abutting surfaces of the hub and lock ring and a corresponding groove on the other of the abutting surfaces into which the tooth is fitted.

In further accordance with the invention, the impeller unit comprises two impellers, one abutting against the collar and the other abutting against the lock ring. A further tooth and groove means is formed between abutting surfaces of the two impellers and between abutting surfaces of the collar and the adjoining impeller.

In further accordance with the invention, the impellers are interchangeable.

In further accordance with the invention the tooth on each impeller can be formed as an attachment on the hub thereof.

DETAILED DESCRIPTION OF PREFERRED EMBODIMENTS

Figure 1:
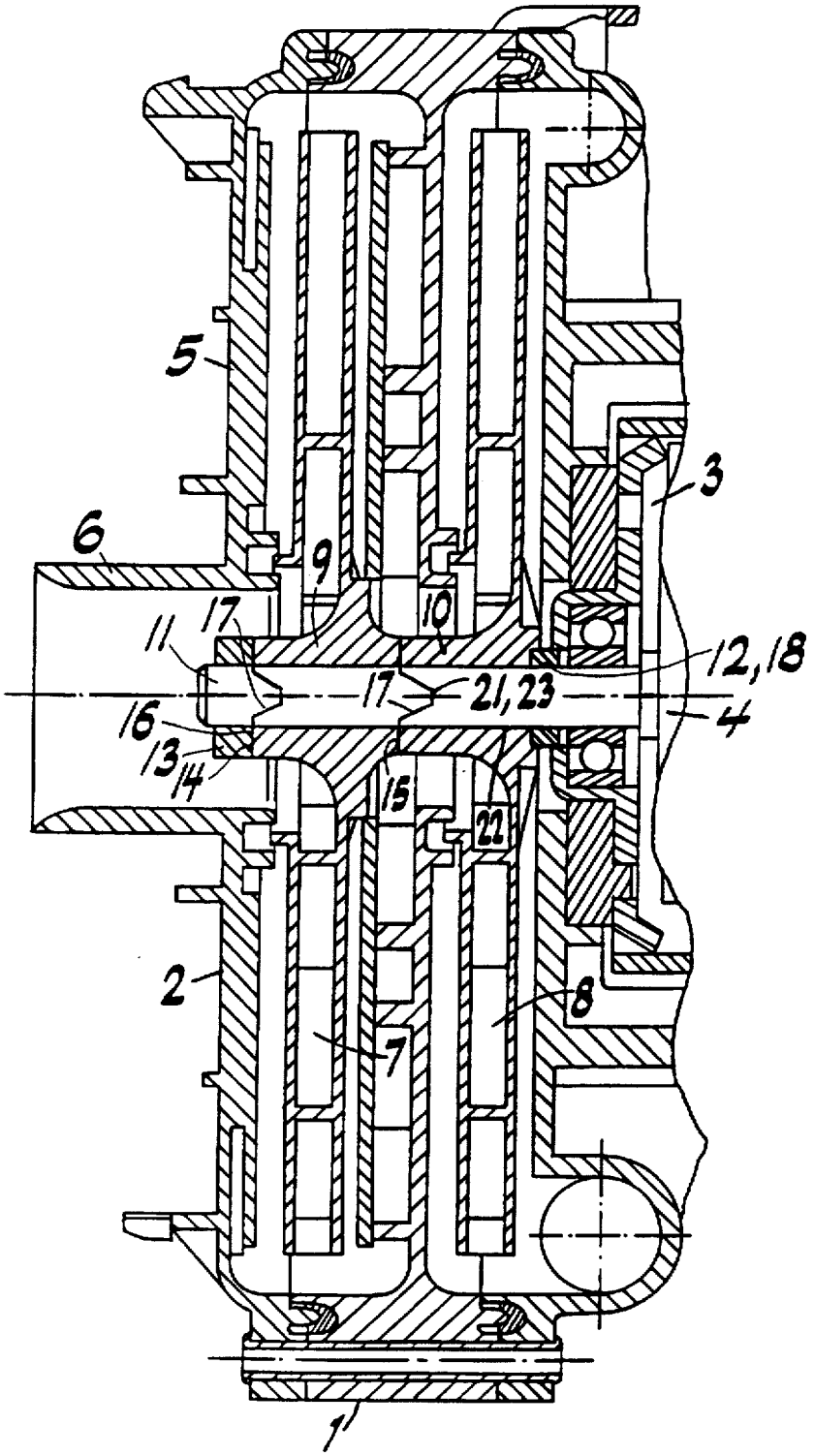
FIG. 1 is a longitudinal sectional view of a portion of an electrically driven air pump showing an improved mounting for the impellers of the pump on the shaft of the motor.

FIG. 1 shows a portion of an air pump which includes the improvement according to the invention. The air pump comprises a housing 1 made of plastic which contains a pump unit 2 driven by an electric motor 4 contained in a chamber 3. The housing 1 is sealed on the pump side by a cover 5 provided with a suction air inlet 6.

In accordance with the invention, the pump unit 2 comprises an impeller unit which includes two injection molded pump impellers 7, 8, that are made of plastic which enables the impellers to be lightweight and favorably shaped regarding air flow characteristics, especially when compared to impellers made of metal. The pump impellers 7, 8 have hubs 9, 10 which are press-fit onto the shaft 11 of the electric motor. The hub 10 of impeller 8 abuts against a collar 12, and the hub 9 of impeller 7 abuts against and is secured by a lock ring 13 that is made of metal. The locking ring 13 is press-fit on the shaft 11. To assemble the impellers on the motor shaft 4, the hub 10 of impeller 8 is slidably advanced on shaft 11 until hub 10 abuts against collar 12 whereafter the hub 9 of impeller 7 is slidably advanced on shaft 11 to abut against hub 9 and then the metal lock ring 13 is press-fit on shaft 4 to abut against hub 9 and clamp the impellers 7, 8 between collar 12 and lock ring 13. In order that the relatively smooth plastic of the impeller hubs does not rotate on the shaft 11, an angular locking means is provided between the abutting surfaces 15 of the impellers 7, 8 between the abutting surfaces 14 of impeller 9 and locking ring 13. The angular locking means is in the form of a tooth and groove means in which a tooth 17 on one abutting surface is fitted in a correspondingly shaped groove 23 in the other abutting surface. In this way, the angular locking means takes the form of a key and keyway. Preferably, collar 12 is formed as a stop ring 18 made of metal which is press-fit on the shaft 11.

Figure 2:
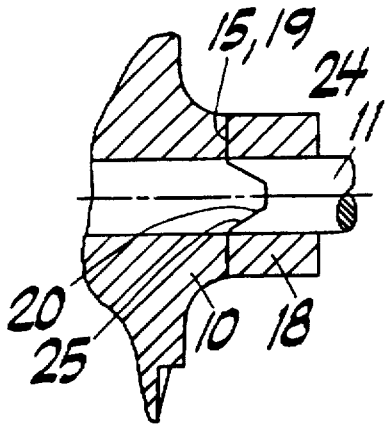
FIG. 2 is a sectional view of a modified arrangement of a portion of the construction shown in FIG. 1.
Figure 3:
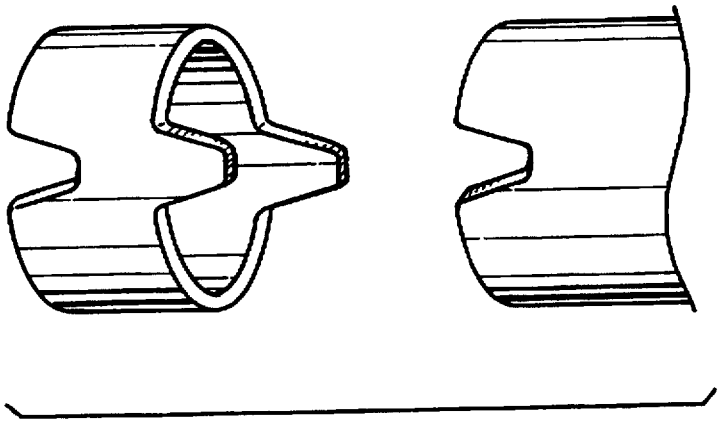
FIG. 3 illustrates the ends of a hub of an impeller of the pump in FIG. 1.

As shown in FIG. 2, the mutually abutting surfaces 15, 19 of the hub 10 of impeller 8 and of the stop ring 18 also have a tooth and groove locking means formed by tooth 20 on hub 10 engaged in groove 24 in the stop ring 18. Consequently, the impellers 7, 8 can be made identically and are interchangeable. The teeth 17 on the impellers can be formed on an attachment 21 secured to the hubs of the impellers whereas the grooves 23 are formed directly in the hubs.

As shown in FIG. 2, the stop ring 18 is provided with a groove 24 which corresponds in shape to groove 23 and the hub 10 of impeller 8 is provided with an attachment 25 that corresponds in shape to the tooth 20 and engages in the groove 24 in ring 18.

After the installation or partial installation of the air pump, the lock ring 13 can be fixed to the shaft 11 by means of laser beam welding and thus be secured against rotation.

Low noise operation has become possible using the air pump in accordance with the invention since lightweight pump impellers can be utilized. In addition, a very simple and inexpensive assembly of the air pump is now made possible according to the invention which will have a long service life.

Although the invention has been described in conjunction with specific embodiments thereof, it will become apparent to those skilled in the art that numerous modifications and variations can be made within the scope and spirit of the invention as defined in the attached claims.

What is claimed is:

1. In an electrically driven air pump having a housing containing a pump unit driven from a shaft of an electric motor, the improvement wherein said pump unit comprises an impeller unit made of plastic and including a hub which is press-fit on the shaft of the electric motor, a collar press-fit on said shaft and abutting against said hub of said impeller unit on a side thereof facing the electric motor, and a lock ring, made of metal press-fit on said shaft and abutting against said hub of said impeller unit on an opposite side thereof facing away from said electric motor, said lock ring and said hub of said impeller unit having mutually abutting surfaces which include respectively engaging tooth and groove means for preventing relative rotary movement therebetween.

2. The improvement as claimed in claim 1 wherein said tooth and groove means comprises a tooth on one of said abutting surfaces of said hub and said lock ring and a corresponding groove on the other of said abutting surfaces, said tooth being fitted in said groove.

3. The improvement as claimed in claim 2 wherein said impeller unit comprises first and second impellers clamped between said lock ring and said collar, said first impeller abutting against said lock ring, said second impeller abutting against said first impeller and against said collar, and further tooth and groove means between abutting surfaces of said first and second impellers and between abutting surfaces of said second impeller and said collar.

4. The improvement as claimed in claim 3 wherein the tooth and groove means between the first and second impellers comprises a further tooth on one of said abutting surfaces of the first and second impellers and a further groove on the other of said abutting surfaces of the first and second impellers receiving said further tooth therein.

5. The improvement as claimed in claim 4 wherein the tooth and groove means between the second impeller and said collar comprises another tooth on one of said abutting surfaces of said second impeller and said collar and another groove in the other of said abutting surfaces of said second impeller and said collar receiving said another tooth therein.

6. The improvement as claimed in claim 5 wherein said first and second impellers are interchangeable.

7. The improvement as claimed in claim 5 wherein said collar is made of metal.

8. The improvement as claimed in claim 2 wherein said hub includes an attachment thereon which includes said tooth.

9. The improvement as claimed in claim 1 wherein said lock ring is secured to said shaft by a weld.

* * * * *